US009395673B2

(12) United States Patent
Matsuno et al.

(10) Patent No.: US 9,395,673 B2
(45) Date of Patent: Jul. 19, 2016

(54) FIXING DEVICE

(71) Applicant: Brother Kogyo Kabushiki Kaisha, Nagoya-shi, Aichi-ken (JP)

(72) Inventors: Takuji Matsuno, Ichinomiya (JP); Kaoru Suzuki, Ichinomiya (JP); Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/866,222

(22) Filed: Sep. 25, 2015

(65) Prior Publication Data

US 2016/0091852 A1 Mar. 31, 2016

(30) Foreign Application Priority Data

Sep. 30, 2014 (JP) ..... 2014-199965

(51) Int. Cl.
*G03G 15/20* (2006.01)
*G03G 15/00* (2006.01)

(52) U.S. Cl.
CPC ..... *G03G 15/657* (2013.01); *G03G 15/2007* (2013.01)

(58) Field of Classification Search
CPC ..... G03G 15/657; G03G 15/2007
See application file for complete search history.

(56) References Cited

U.S. PATENT DOCUMENTS 8,909,118 B2 * 12/2014 Seol ..... G03G 15/2053 399/329
2009/0016789 A1 * 1/2009 Kim ..... G03G 15/2064 399/329
2012/0008971 A1 1/2012 Lee et al.

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A fixing device includes: an endless belt; a heater; a nip plate; a backup member, a reflective plate, a stay and a heat insulating member, wherein the heat insulating member includes: an upstream support face, which supports the nip plate; and a downstream support face, which is disposed separated downstream in the conveyance direction from the upstream support face and supports the nip plate, and wherein a gap in the conveyance direction between the upstream support face and the downstream support face at a central portion in the longitudinal direction of the heat insulating member is smaller than a gap in the conveyance direction between the upstream support face and the downstream support face at an end portion in the longitudinal direction of the heat insulating member.

20 Claims, 10 Drawing Sheets

FIXING DEVICE

CROSS-REFERENCE TO RELATED APPLICATION

This application claims priority from Japanese Patent Application No. 2014-199965 filed on Sep. 30, 2014, the entire subject matter of which is incorporated herein by reference.

TECHNICAL FIELD

This disclosure relates to a fixing device to heat-fix a developer onto a recording sheet.

BACKGROUND

A fixing device of a background art includes an endless belt, a nip plate capable of being in contact with the inner circumferential surface of the endless belt, and a pressure roller interposing the endless belt between the nip plate and the pressure roller. In the fixing device, a nip is formed between the endless belt and the pressure roller, and a developer image is heat-fixed onto a recording sheet when the recording sheet passes through the nip.

In the configuration according to the background art, there is a possibility that a crinkle will be formed in the recording sheet when the recording sheet passes through the nip.

SUMMARY

Therefore, this disclosure is to provide a fixing device capable of suppressing a crinkle from being formed in a recording sheet.

A fixing device of this disclosure includes: an endless belt; a heater, which extends inside the endless belt; a nip plate, which comes into contact with an inner circumferential surface of the endless belt; a backup member, which forms a nip between the endless belt and the backup member by interposing the endless belt between the nip plate and the backup member; a reflective plate, which is disposed between the heater and the nip plate; a stay, which is disposed between the reflective plate and the nip plate; and a heat insulating member, which is interposed between the stay and the nip plate, the fixing device heat-fixing a developer on a recording sheet while conveying the recording sheet in a conveyance direction perpendicular to a longitudinal direction of the heat insulating member in the nip, wherein the heat insulating member includes: an upstream support face, which supports the nip plate; and a downstream support face, which is disposed separated downstream in the conveyance direction from the upstream support face and supports the nip plate, and wherein a gap in the conveyance direction between the upstream support face and the downstream support face at a central portion in the longitudinal direction of the heat insulating member is smaller than a gap in the conveyance direction between the upstream support face and the downstream support face at an end portion in the longitudinal direction of the heat insulating member.

A fixing device of this disclosure includes: an endless belt; a heater, which extends inside the endless belt; a nip member, which comes into contact with an inner circumferential surface of the endless belt; a backup member, which forms a nip between the endless belt and the backup member by interposing the endless belt between the nip member and the backup member; a reflective member, which is disposed between the heater and the nip member; a stay, which is disposed between the reflective member and the nip member; and an intermediate member, which is interposed between the stay and the nip member, the fixing device heat-fixing a developer on a recording sheet while conveying the recording sheet in a conveyance direction perpendicular to a longitudinal direction of the intermediate member in the nip, wherein the intermediate member includes: an upstream support face, which supports the nip member; and a downstream support face, which is disposed separated downstream in the conveyance direction from the upstream support face and that supports the nip member, and wherein a gap in the conveyance direction between the upstream support face and the downstream support face at a central portion in the longitudinal direction of the intermediate member is smaller than a gap in the conveyance direction between the upstream support face and the downstream support face at an end portion in the longitudinal direction of the intermediate member.

According to this disclosure relate to the heat insulating member or the intermediate member, it is possible to suppress a crinkle from being formed in a recording sheet.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Embodiments of the disclosure will be described in detail properly with reference to the accompanying drawings. In the following description, an electrophotographic printer 1 including a fixing device 5 will be first schematically described, and then details of the fixing device 5 will be described.

Figure 1:
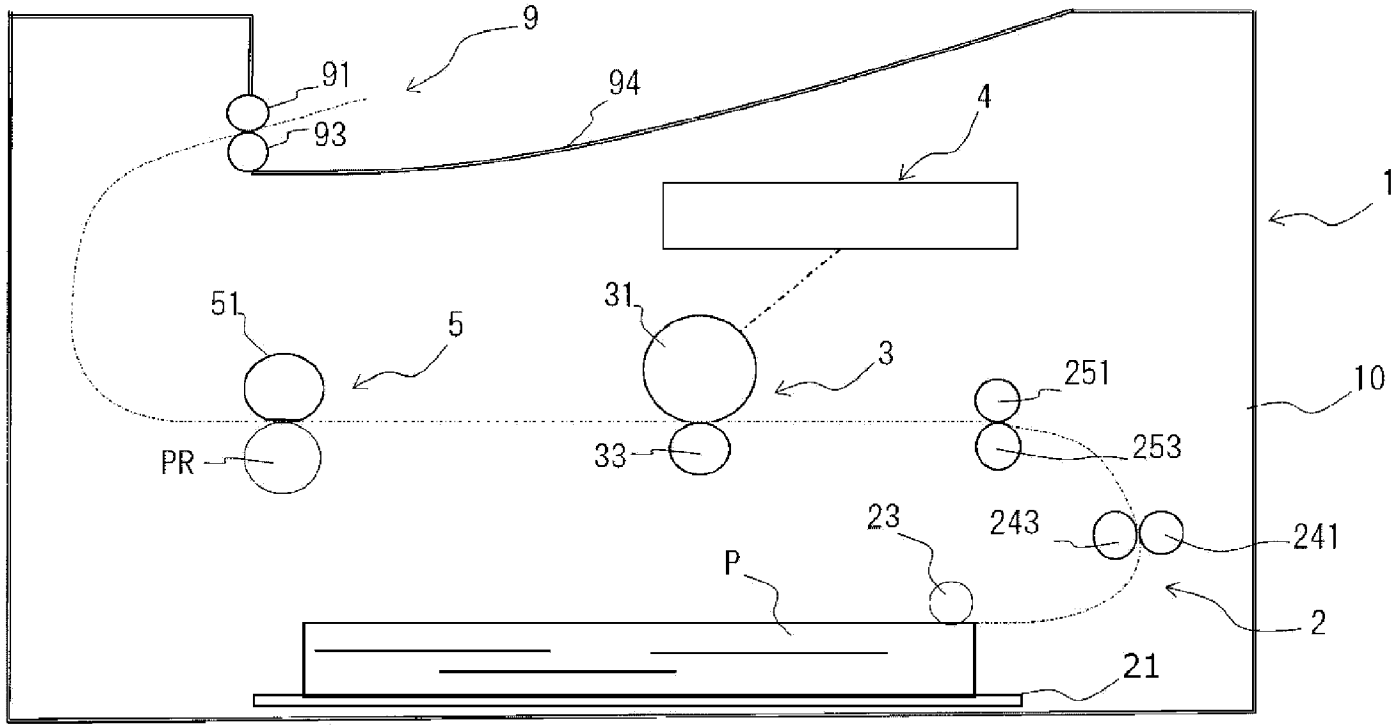
FIG. 1 is a schematic cross-sectional view of the center of a printer.

The schematic configuration of the printer 1 will be first described below. As illustrated in FIG. 1, the printer 1 includes a housing 10. The printer 1 further includes a sheet feeding device 2, a transfer device 3, an exposure device 4, and a fixing device 5 which are disposed inside the housing 10. The printer 1 further includes a sheet discharging device 9.

The sheet feeding device 2 includes a tray 21, a pickup roller 23, a sheet feeding roller 241, a follower roller 243 adjacent to the sheet feeding roller 241, a registration roller 251, and a follower roller 253 adjacent to the registration roller 251. The transfer device 3 includes a photosensitive drum 31 and a transfer roller 33. The exposure device 4 includes a semiconductor laser and a lens. The fixing device 5 includes an endless belt 51 and a pressure roller PR that forms a nip between the endless belt 51 and the pressure roller PR. The sheet discharging device 9 includes a sheet discharging roller 91, a follower roller 93 adjacent to the sheet discharging roller 91, and a sheet discharging tray 94. The sheet discharging tray 94 is a part of the housing 10.

The schematic operation of the printer 1 will be described below. The printer 1 performs this operation (printing operation) when the printer 1 is powered on, and the printer 1 receives a print command.

When the printer 1 receives the print command, the pickup roller 23 picks up a sheet P placed on the tray 21 and conveys the picked-up sheet P. The sheet feeding roller 241 and the follower roller 243 further conveys the sheet P conveyed from the pickup roller 23 downstream. The registration roller 251 and the follower roller 253 arranges an inclination of the tip of the sheet P conveyed from the sheet feeding roller 241 and the follower roller 243 and then further conveys the sheet P downstream.

The exposure device 4 irradiates the photosensitive drum 31 with light to form an electrostatic latent image on the surface of the photosensitive drum 31. The electrostatic latent image is developed into a developer image by supplying developer from a development roller (not illustrated) to the photosensitive drum 31. The photosensitive drum 31 and the transfer roller 33 transfers the developer image onto the sheet P which has been conveyed to a transfer nip formed between the photosensitive drum 31 and the transfer roller 33 from the registration roller 251.

The fixing device 5 heat-fixes the developer image onto the sheet P when the transfer device 3 conveys the sheet P to a fixing nip between the endless belt 51 and the pressure roller PR. The sheet discharging roller 91 and the follower roller 93 discharge the sheet P conveyed by the fixing device 5 onto the sheet discharging tray 94.

Figure 2:
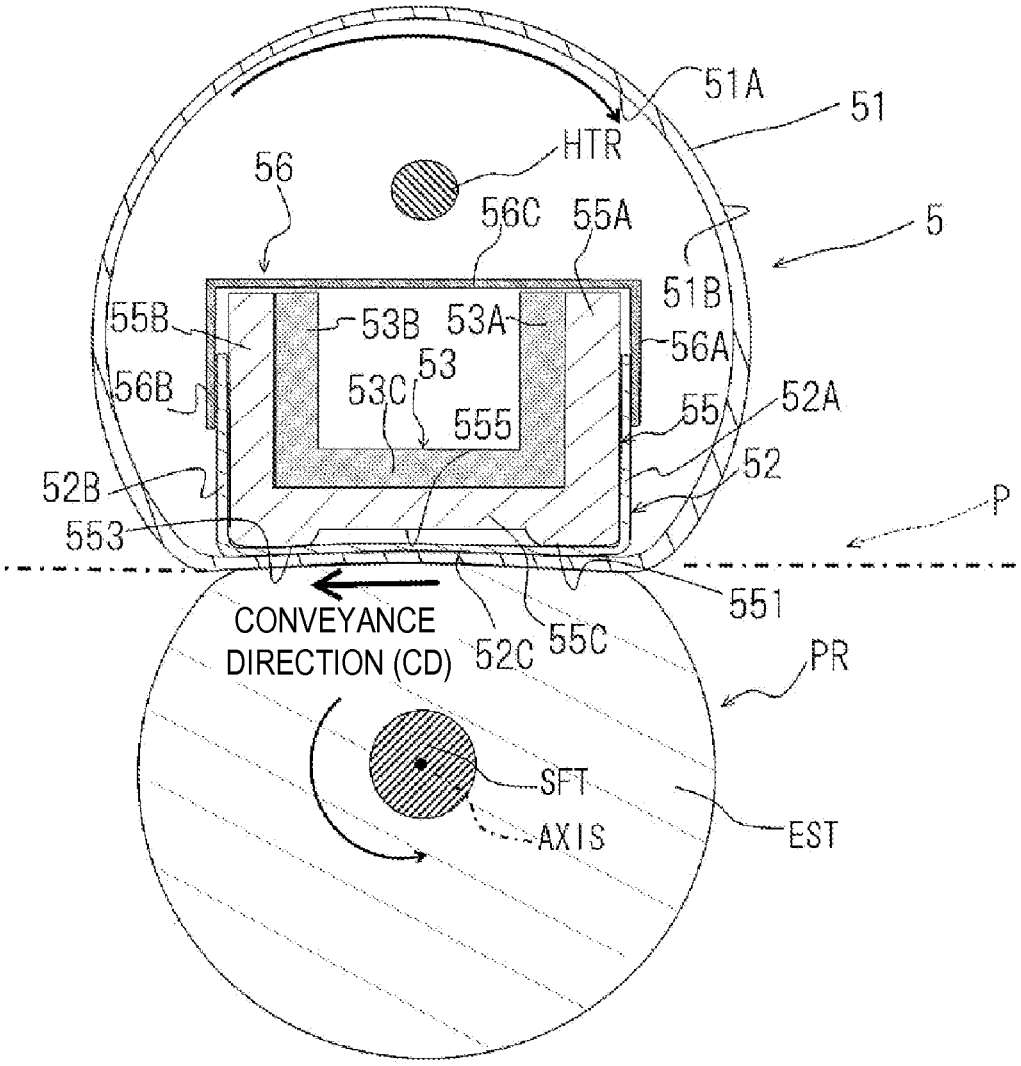
FIG. 2 is a cross-sectional view of the center of a fixing device.
Figure 3:
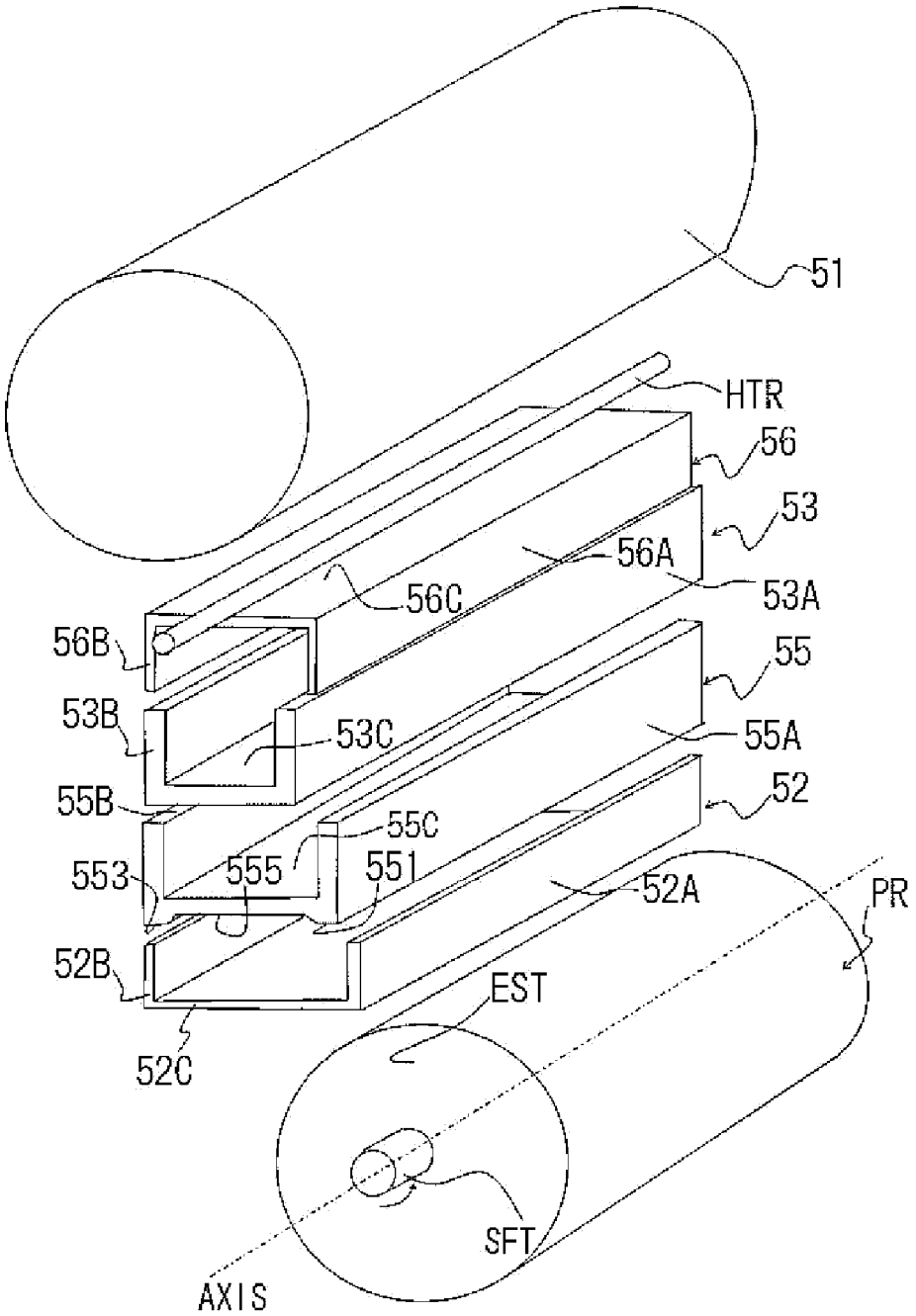
FIG. 3 is an exploded perspective view of the fixing device.
Figure 4:
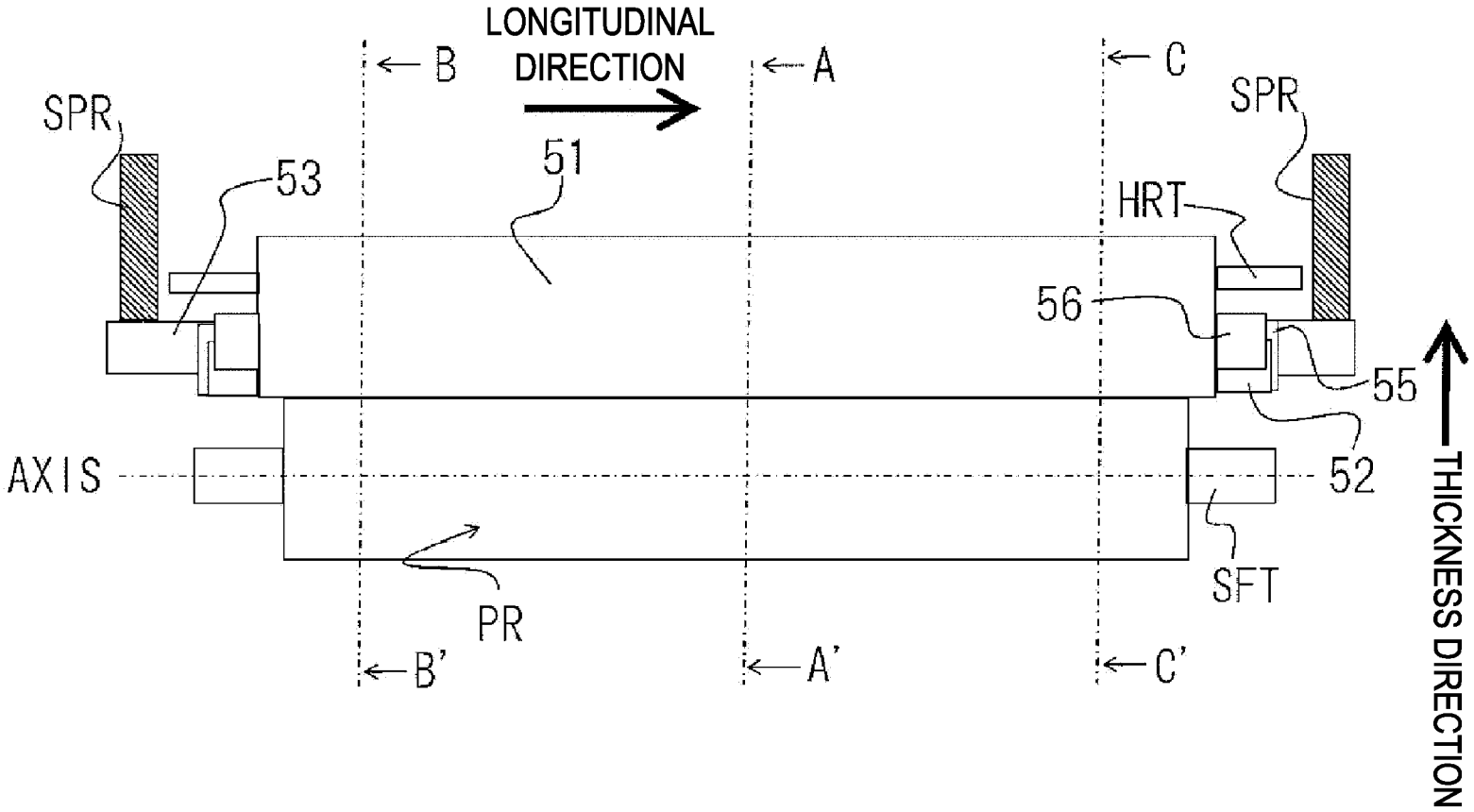
FIG. 4 is a view of the fixing device as viewed from a conveyance direction of a sheet.

The detailed configuration of the fixing device 5 will be described below. FIG. 2 is a cross-sectional view of the center of the fixing device 5, FIG. 3 is an exploded perspective view of the fixing device 5, and FIG. 4 is a view of the fixing device 5 as viewed from an upstream side in a sheet conveyance direction in the fixing nip (NIP).

As illustrated in FIG. 2, the fixing device 5 includes the endless belt 51, a heater HTR extending inside the endless belt 51, a nip plate 52 which can come in contact with the inner circumferential surface of the endless belt 51, a heat insulating member 55 as an example of the intermediate member extending inside the endless belt 51, a reflective plate 56 extending inside the endless belt 51, and the pressure roller RP as an example of the backup member disposed outside the endless belt 51. The fixing device includes a spring SPR for pressing a stay 53. The fixing device conveys a sheet P in a predetermined conveyance direction (CD) in the fixing nip (NIP).

The endless belt 51 includes a base layer and a release layer covering the surface of the base layer. The base layer may be a metal layer including stainless steel (SUS) or nickel alloy or may be a resin layer including polyimide resin. The base layer may contain various additives. For example, when the base layer is a resin layer, the resin layer may contain metal, ceramics, carbon, or resin as the additives.

The release layer is a resin layer containing a fluororesin such as tetrafluoroethylene-perfluoroalkyl vinyl ether copolymer (PFA) or polytetrafluoroethylene (PTFE). The release layer may contain carbon or the like as an additive. The endless belt 51 may further include an elastic layer disposed between the base layer and the release layer. The elastic layer may be, for example, a silicone rubber layer having heat resistance. The elastic layer may contain carbon, ceramic, or metal as an additive. The endless belt 51 has a tubular shape and includes an inner circumferential surface 51A and an outer circumferential surface 51B.

For example, the thickness of the endless belt 51 ranges from several tens of μm to several hundreds of μm. For example, the thickness of the endless belt 51 may range from 5 μm to 800 μm, from 10 μm to 500 μm, from 10 μm to 300 μm, or from 10 μm to 200 μm.

The heater HTR is longer than the endless belt 51 in the longitudinal direction of the heat insulating member 55, extends inside the endless belt 51, and extends to the outside of the endless belt 51 over the end faces of the endless belt 51 as illustrated in FIG. 4. The heater HTR may be a halogen lamp or may be a carbon heater. The heater HTR may be an infrared heater. The halogen lamp includes a glass tube and a heat source disposed inside the glass tube. Here, the longitudinal direction of the heat insulating member 55 is substantially parallel to a direction (axial direction) in which an axis AXIS of the pressure roller PR extends.

The nip plate 52 is longer than the endless belt 51 in the longitudinal direction of the heat insulating member 55 and can come in contact with the inner circumferential surface of the endless belt 51. The nip plate 52 is a metal plate which is elastically deformable such as a stainless steel (SUS) plate or an aluminum plate and may include an oxide film, a fluororesin film, or the like as a surface layer. The thickness of the nip plate 52 may range from 0.05 mm to 5 mm, from 0.1 mm to 3 mm, from 0.5 mm to 2 mm, or from 0.9 mm to 1.5 mm.

As illustrated in FIG. 2, the nip plate 52 includes an upstream portion 52A, a downstream portion 52B disposed downstream in the conveyance direction (CD) from the upstream portion 52A, and a central portion 52C connecting the upstream portion 52A and the downstream portion 52B.

As illustrated in FIG. 2, the central portion 52C of the nip plate 52 extends from the upstream side in the conveyance direction (CD) of the heater HTR to the downstream side in the conveyance direction (CD) of the heater HTR. The upstream portion 52A extends from the upstream end in the conveyance direction (CD) of the central portion 52C in a direction in which it separates from the pressure roller PR. The downstream portion 52B extends from the downstream end in the conveyance direction (CD) of the central portion 52C in a direction in which it separates from the pressure roller PR. According to this configuration, the nip plate 52 forms a depressed portion which is concave in a direction in which it approaches the fixing nip (NIP), and has substantially a U-shape.

The reflective plate 56 is longer than the endless belt 51 in the longitudinal direction of the heat insulating member 55 and is disposed between the heater HTR and the nip plate 52 as illustrated in FIG. 2, and the reflective plate 56 includes an upstream portion 56A, a downstream portion 56B disposed downstream in the conveyance direction (CD) from the upstream portion 56A, and a central portion 56C connecting the upstream portion 56A and the downstream portion 56B. The reflective plate 56 is a metal plate such as an aluminum plate or a stainless steel (SUS) plate and a surface (reflective surface) facing the heater HTR is subjected to mirror finishing. The reflective plate 56 is a mirror. The thickness of the reflective plate 56 may range from 0.05 mm to 5 mm, from 0.1 mm to 3 mm, from 0.5 mm to 2 mm, or from 0.9 mm to 1.5 mm.

As illustrated in FIG. 2, the central portion 56C of the reflective plate 56 extends from the upstream side in the conveyance direction (CD) of the heater HTR to the downstream side in the conveyance direction (CD) of the heater HTR. The central portion 56C includes a reflective surface which faces the heater HTR to reflect radiant heat from the heater HTR to the inner circumferential surface 51A of the endless belt 51. The upstream portion 56A extends from the upstream end in the conveyance direction (CD) of the central portion 56C toward the pressure roller PR. The downstream portion 56B extends from the downstream end in the conveyance direction (CD) of the central portion 56C toward the pressure roller PR.

According to this configuration, the reflective plate 56 forms a depressed portion which is concave in a direction, in which it separates from the fixing nip (NIP), and has substantially a U shape. The reflective plate 56 is disposed to cover most of the stay 53 and most of the heat insulating member 55 from the opposite side of the nip plate 52. In other words, as will be described later, most of the stay 53 and the heat insulating member 55 are disposed between the nip plate 52 and the reflective plate 56 and is surrounded with the nip plate 52 and the reflective plate 56.

As illustrated in FIG. 2, the stay 53 is disposed between the reflective plate 56 and the nip plate 52, and includes an upstream wall 53A, a downstream wall 53B disposed downstream in the conveyance direction (CD) from the upstream wall 53A, and a central wall 53C connecting the upstream wall 53A and the downstream wall 53B. The stay 53 is a metal frame such as a stainless steel (SUS) frame, an aluminum frame, or an iron frame and has rigidity higher than that of the nip plate 52 or the heat insulating member 55. The thickness of each of the upstream wall 53A, the downstream wall 53B, and the central wall 53C of the stay 53 may range from 2.0 mm to 25 mm, from 5.0 mm to 15 mm, from 0.9 mm to 10 mm, or from 1.0 mm to 9 mm. As illustrated in FIG. 4, the stay 53 is longer than any one of the endless belt 51, the nip plate 52, the reflective plate 56, the heater HTR, and the heat insulating member 55 in the longitudinal direction of the heat insulating member 55.

As illustrated in FIG. 2, the central wall 53C of the stay 53 extends from the upstream side in the conveyance direction (CD) of the heater HTR to the downstream side in the conveyance direction (CD) of the heater HTR. The size, in the conveyance direction (CD), of the central wall 53C of the stay 53 is smaller than the size, in the conveyance direction (CD), of the central portion 56C of the reflective plate 56. The upstream wall 53A of the stay 53 extends from the upstream end in the conveyance direction (CD) of the central wall 53C in a direction in which it separates from the pressure roller PR. The downstream wall 53B of the stay 53 extends from the downstream end in the conveyance direction (CD) of the central wall 53C in a direction in which it separates from the pressure roller PR.

According to this configuration, the stay 53 forms a depressed portion which is concave in a direction in which it approaches the fixing nip (NIP), and has substantially a U shape. At least a part of the stay 53 is disposed inside the depressed portion formed by the reflective plate 56.

As illustrated in FIG. 4, the spring SPR can elastically support the heat insulating member 55 and the nip plate 52 toward the pressure roller PR with the stay 53 interposed therebetween. An arm or the like for providing a link ratio may be disposed between the spring SPR and the stay 53.

The pressure roller PR includes a shaft SFT and an elastic layer EST covering most of the shaft SFT and can rotate around a rotation axis AXIS as illustrated in FIG. 2. The fixing nip (NIP) can be formed between the endless belt 51 and the pressure roller PR by interposing the endless belt 51 between the nip plate 52 and the pressure roller PR.

As illustrated in FIG. 2, the heat insulating member 55 is disposed between the stay 53 and the nip plate 52 and includes an upstream wall 55A, a downstream wall 55B disposed downstream in the conveyance direction (CD) from the upstream wall 55A, and a central wall 55C connecting the upstream wall 55A and the downstream wall 55B.

As illustrated in FIG. 2, the central wall 55C of the heat insulating member 55 extends from the upstream side in the conveyance direction (CD) of the heater HTR to the downstream side in the conveyance direction (CD) of the heater HTR. The size, in the conveyance direction (CD), of the central wall 55C of the heat insulating member 55 is smaller than the size, in the conveyance direction (CD), of the central wall 53C of the stay 53. The upstream wall 55A of the heat insulating member 55 extends from the upstream end in the conveyance direction (CD) of the central wall 55C in a direction in which it separates from the pressure roller PR. The downstream wall 55B extends from the downstream end in the conveyance direction (CD) of the central wall 53C in a direction in which it separates from the pressure roller PR.

According to this configuration, the stay 53 forms a depressed portion which is concave in a direction in which it approaches the fixing nip (NIP), and has substantially a U shape. At least a part of the heat insulating member 55 is disposed inside the depressed portion formed by the reflective plate 56. At least a part of the stay 53 is disposed inside the depressed portion formed by the heat insulating member 55, and the stay 53 supports the heat insulating member 55 in the depressed portion formed by the heat insulating member 55.

The heat insulating member 55 is a member which has rigidity lower than those of the stay 53 and the nip plate 52 and which has a difficulty in transmitting heat (which has low heat conductivity) and is a heat-resistance resin frame such as a fluorine-based resin frame or a liquid crystal plastic (LCP) frame. The thickness of each of the upstream wall 55A, the downstream wall 55B, and the central wall 55C of the heat insulating member 55 may range from 2.0 mm to 25 mm, from 5.0 mm to 15 mm, from 0.9 mm to 10 mm, or from 1.0 mm to 9.0 mm.

Figure 5:
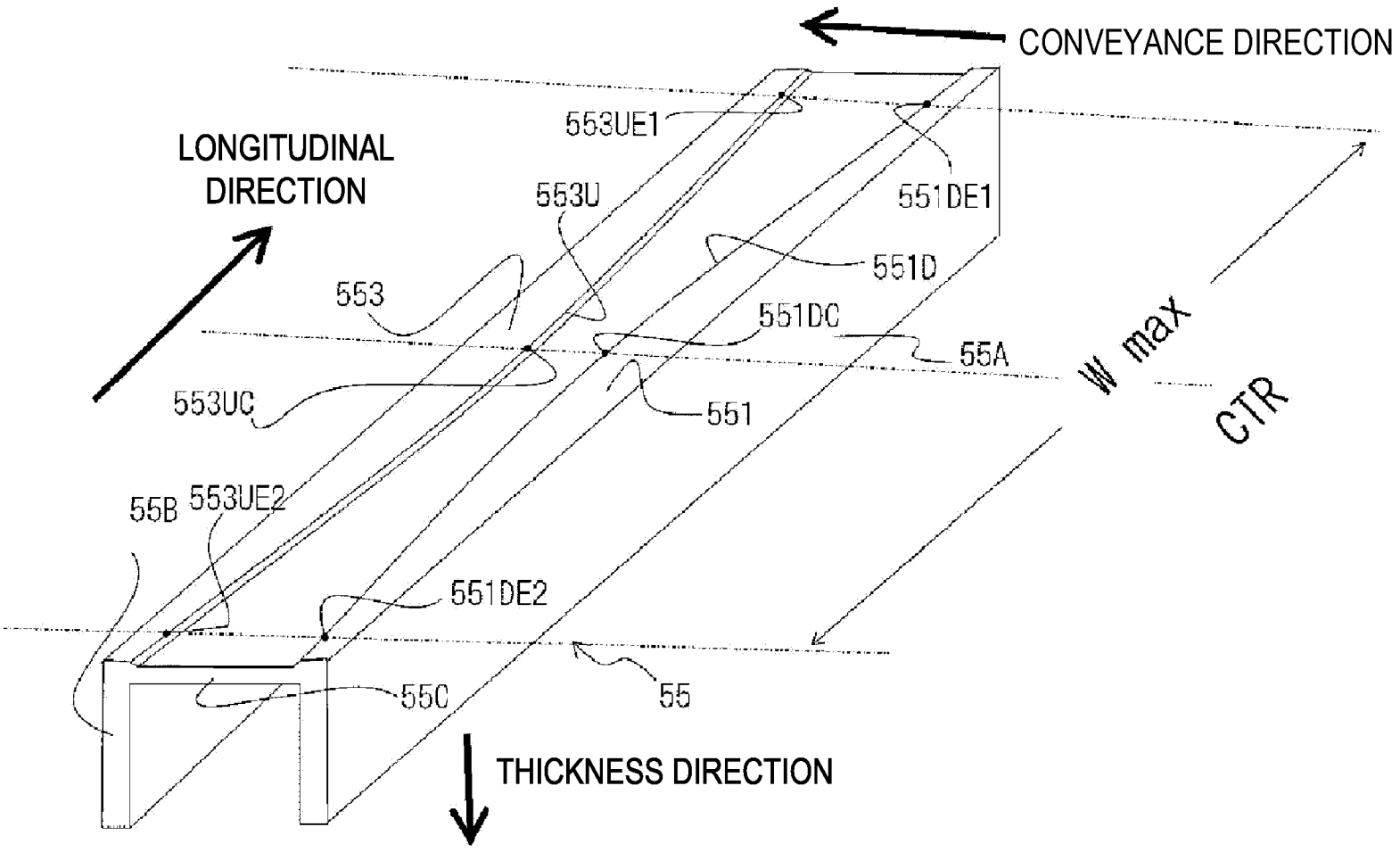
FIG. 5 is a perspective view of a heat insulating member.

The central wall 55C of the heat insulating member 55 will be described below in more detail. FIG. 5 is a perspective view of the heat insulating member 55, FIG. 6 is a view of the heat insulating member 55 as viewed from the fixing nip (NIP) side, and FIG. 7 is a view of the heat insulating member 55 as viewed from the conveyance direction (CD).

At least a part of the central wall 55C of the heat insulating member 55 is disposed inside the depressed portion formed by the nip plate 52. The central wall 55C of the heat insulating member 55 includes an upstream support face 551 and a downstream support face 553, which support the central portion 52C of the nip plate 52 from the opposite side of the fixing nip (NIP). The downstream support face 553 is disposed separated downstream in the conveyance direction (CD) from the upstream support face 551.

Figure 6:
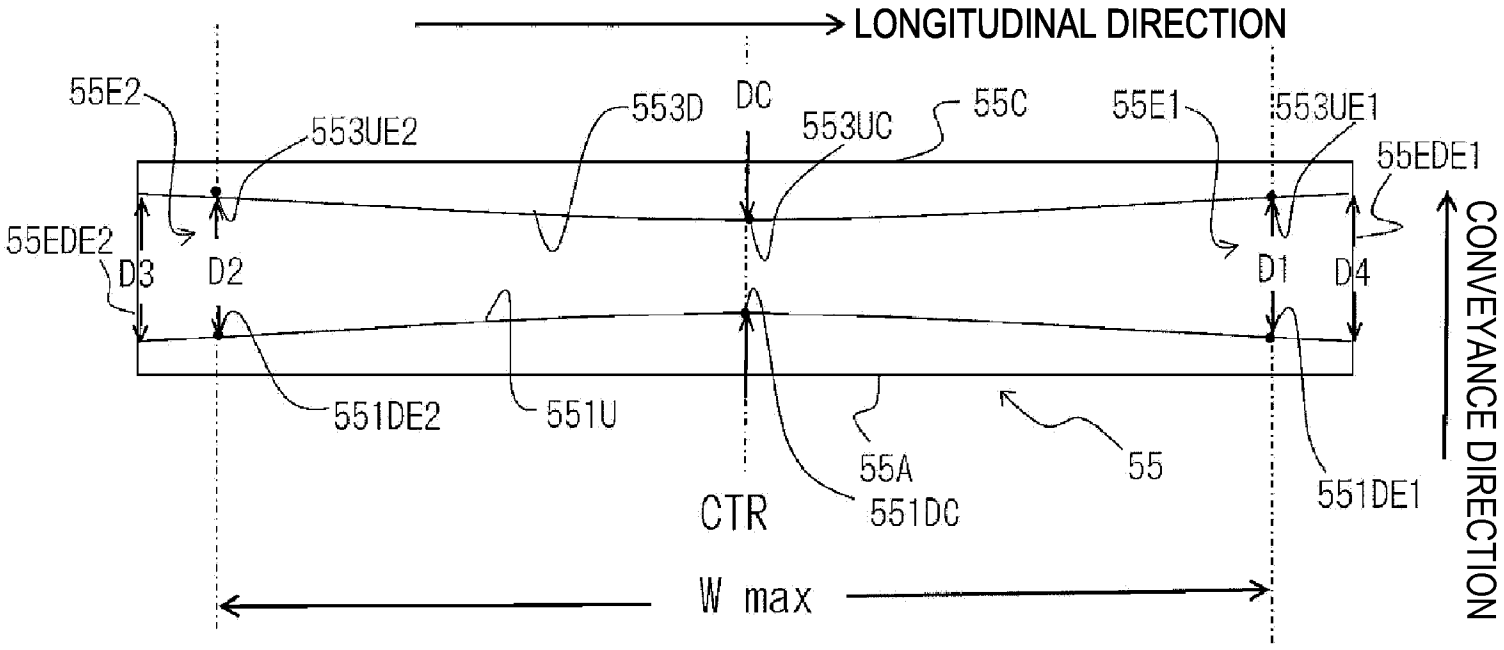
FIG. 6 is a view of the heat insulating member as viewed from a fixing nip.
Figure 7:
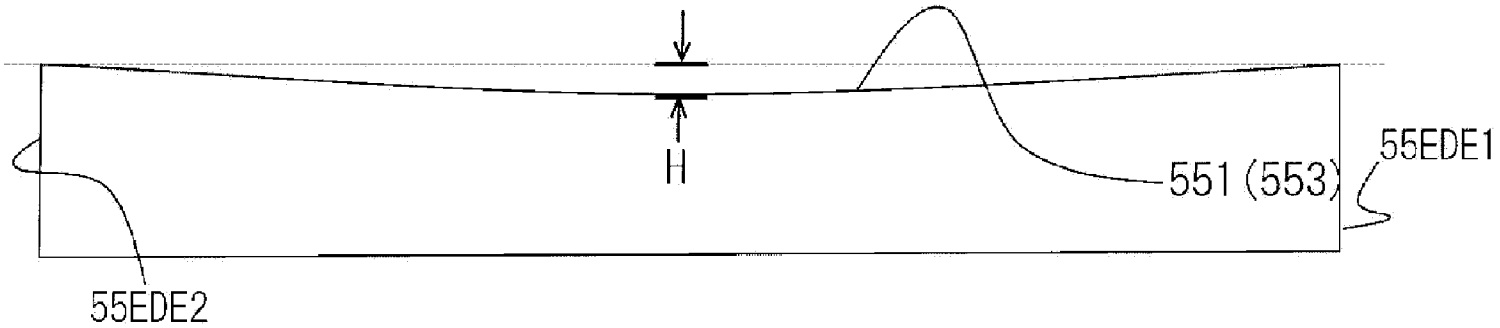
FIG. 7 is a view of the heat insulating member as viewed from the conveyance direction of a sheet.

As illustrated in FIG. 6, the upstream support face 551 extends from one end portion 55E1 of the heat insulating member 55 to the other end portion 55E2 of the heat insulating member 55. As illustrated in FIG. 6, the upstream support face 551 extends from one end 55EDE1 of the heat insulating member 55 to the other end 55EDE2 of the heat insulating member 55.

As illustrated in FIGS. 5 and 6, the upstream support face 551 includes a downstream edge 551D in the conveyance direction (CD). The downstream edge 551D of the upstream support face 551 includes a central portion 551DC overlapping a sheet conveyance center (CTR) as viewed in the thickness direction of the sheet P from the fixing nip (NIP), an end portion 551DE1 overlapping one end of a maximum sheet conveyance area as viewed in the thickness direction of the sheet P from the fixing nip (NIP), and an end portion 551DE2 overlapping the other end of the maximum sheet conveyance area as viewed in the thickness direction of the sheet P from the fixing nip (NIP). The central portion 551DC overlaps the center in the longitudinal direction of the heat insulating member 55 as viewed in the thickness direction of the sheet P from the fixing nip (NIP). In this embodiment, the thickness direction of the sheet P can be also referred to as a direction perpendicular to both the conveyance direction (CD) of the sheet P in the fixing nip (NIP) and the width direction of the sheet P (the longitudinal direction of the heat insulating member 55). In this embodiment, the conveyance direction (CD) of the sheet P can also be referred to as a rotation direction (moving direction) of the endless belt 11 in the fixing nip (NIP).

The sheet conveyance center (CTR) refers to the center in the sheet width direction of the sheet conveyance area in the fixing nip (NIP). The maximum sheet conveyance area indicates the conveyance area of a sheet having the maximum sheet width among sheets which can be used in the fixing device 5. Examples of the sheet having the maximum sheet width include a legal-size sheet (with a sheet width of 279 mm), an A4-size sheet (with a sheet width of 210 mm), and an A3-size sheet (with a sheet width of 297 mm). The center in the longitudinal direction of the heat insulating member 55 is a part at which the distances from one end and the other end in the longitudinal direction of the heat insulating member are equal.

The downstream edge 551D of the upstream support face 551 has a bow shape which swells toward the downstream support face 553 and the central portion 551DC thereof is closer to the downstream support face 553 than the end portions 551DE1 and 551DE2.

As illustrated in FIG. 7, the upstream support face 551 has a concave shape which is depressed in a bow shape so as to be separated from the nip toward the center in the longitudinal direction of the heat insulating member 55. The central portion 553UC overlaps the center in the longitudinal direction of the heat insulating member 55 as viewed in the thickness direction of the sheet P from the fixing nip (NIP). The degree of depression H of the center in the longitudinal direction of the upstream support face 551 with respect to the ends in the longitudinal direction of the upstream support face 551 may range from 0.05 mm to 0.3 mm or may be less than 0.1 mm.

As illustrated in FIG. 6, the downstream support face 553 extends from one end portion 55E1 of the heat insulating member 55 to the other end portion 55E2 of the heat insulating member 55. As illustrated in FIG. 6, the downstream support face 553 extends from one end 55EDE1 of the heat insulating member 55 to the other end 55EDE2 of the heat insulating member 55.

As illustrated in FIGS. 5 and 6, the downstream support face 553 includes an upstream edge 553U in the conveyance direction (CD). The upstream edge 553U of the downstream support face 553 includes a central portion 553UC overlapping the sheet conveyance center (CTR) as viewed in the thickness direction of the sheet P from the fixing nip (NIP), an end portion 553UE1 overlapping one end of the maximum sheet conveyance area as viewed in the thickness direction of the sheet P from the fixing nip (NIP), and an end portion 553UE2 overlapping the other end of the maximum sheet conveyance area as viewed in the thickness direction of the sheet P from the fixing nip (NIP).

The upstream edge 553U of the downstream support face 553 has a bow shape which swells toward the upstream support face 551 and the central portion 553UC thereof is closer to the upstream support face 551 than the end portions 553UE1 and 553UE2.

As illustrated in FIG. 7, the downstream support face 553 has a concave shape which is depressed in a bow shape so as to be separated from the nip toward the center in the longitudinal direction of the heat insulating member 55. The degree of depression H of the center in the longitudinal direction of the downstream support face 553 with respect to the ends in the longitudinal direction of the downstream support face 553 may range from 0.05 mm to 0.3 mm or may be less than 0.1 mm.

As illustrated in FIG. 6, a difference S between a gap D1 (D2) in the conveyance direction (CD) between the upstream support face 551 and the downstream support face 553 in the end portions in the longitudinal direction of the heat insulating member 55 and a gap (DC) in the conveyance direction (CD) between the upstream support face 551 and the downstream support face 553 in the central portion in the longitudinal direction of the heat insulating member 55 may range from 0.1 mm to 6.0 mm, from 0.5 mm to 4.5 mm, from 0.9 mm to 3.5 mm, or from 1.0 mm to 3.5 mm.

As illustrated in FIG. 6, a difference S between a gap D4 (D3) in the conveyance direction (CD) between the upstream support face 551 and the downstream support face 553 at the edges in the longitudinal direction of the heat insulating member 55 and a gap (DC) in the conveyance direction (CD) between the upstream support face 551 and the downstream support face 553 in the central portion in the longitudinal direction of the heat insulating member 55 may range from 0.1 mm to 7.0 mm, from 0.5 mm to 4.7 mm, from 0.9 mm to 3.7 mm, or from 1.0 mm to 3.7 mm.

The fixing operation of the fixing device 5 will be described below. The fixing operation of the fixing device 5 is carried out in the printing operation.

The nip plate 52 is pressed against the pressure roller PR by an elastic supporting force of the spring SPR with the stay 53 and the heat insulating member 55 interposed therebetween. By pressing the nip plate 52 in this way, the nip plate 52 and the pressure roller PR forms the fixing nip (NIP) between the endless belt 51 and the pressure roller PR with the endless belt 51 interposed between the nip plate 52 and the pressure roller PR. The operation of forming the fixing nip (NIP) may be performed in the printing operation as described above, but the fixing nip (NIP) may be always held except for the printing operation.

A motor (not illustrated) drives the pressure roller PR, the pressure roller PR rotates around the rotation axis (AXIS) in the counterclockwise direction in FIG. 2 as illustrated in FIG. 2. By rotating the pressure roller PR in this way, the endless belt 51 rotates in the clockwise direction in FIG. 2 as illustrated in FIG. 2.

The heater HTR emits radiant heat by powering on the heater HTR. The reflective plate 56 reflects radiant heat from the heater HTR to the inner circumferential surface 51A of the endless belt 51. The endless belt 51 is heated by the radiant heat reflected by the reflective plate 56 and accumulates the heat. The endless belt 51 transmits the accumulated heat to the fixing nip (NIP) by rotation.

The endless belt 51 having accumulated the heat and the pressure roller PR give heat and pressure to a developer image on the sheet P by interposing the sheet P therebetween in the fixing nip (NIP) and thermally fix the developer image onto the sheet P.

Figure 8:
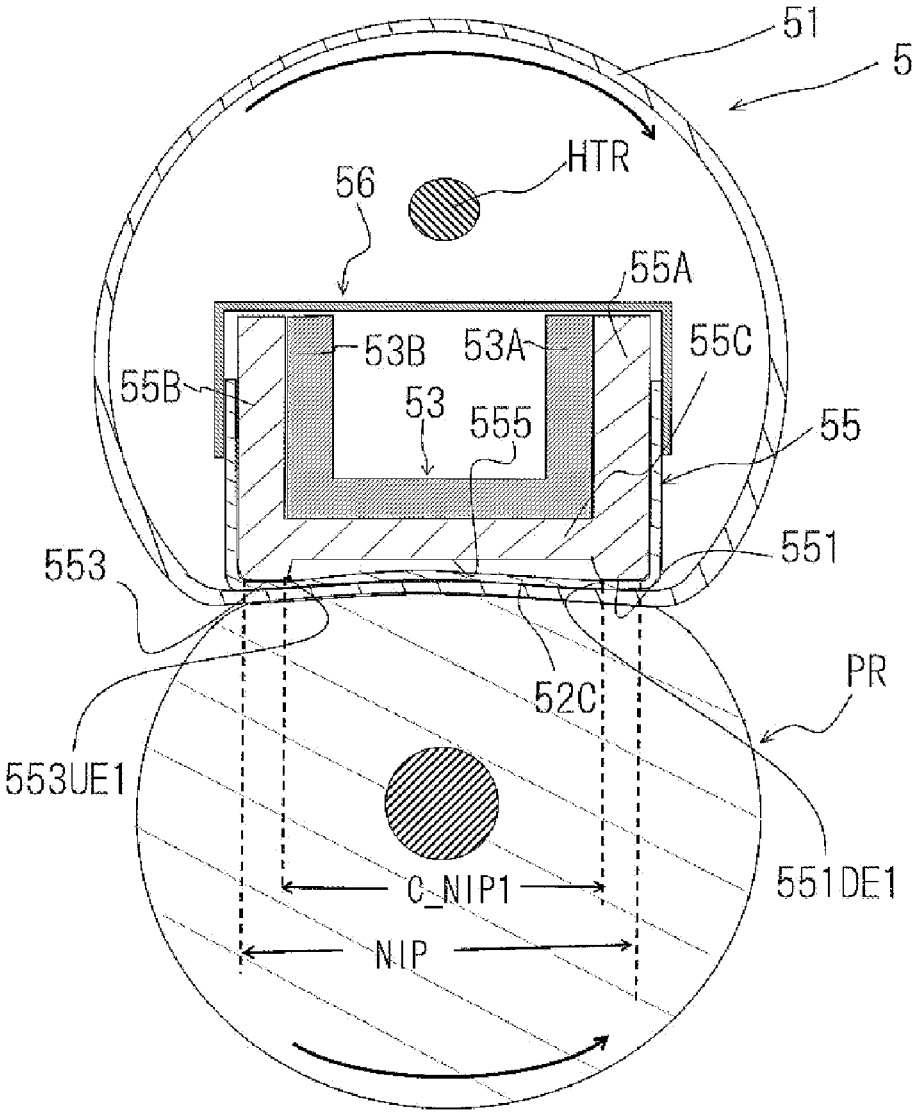
FIG. 8 is a cross-sectional view of an end of the fixing device.
Figure 9:
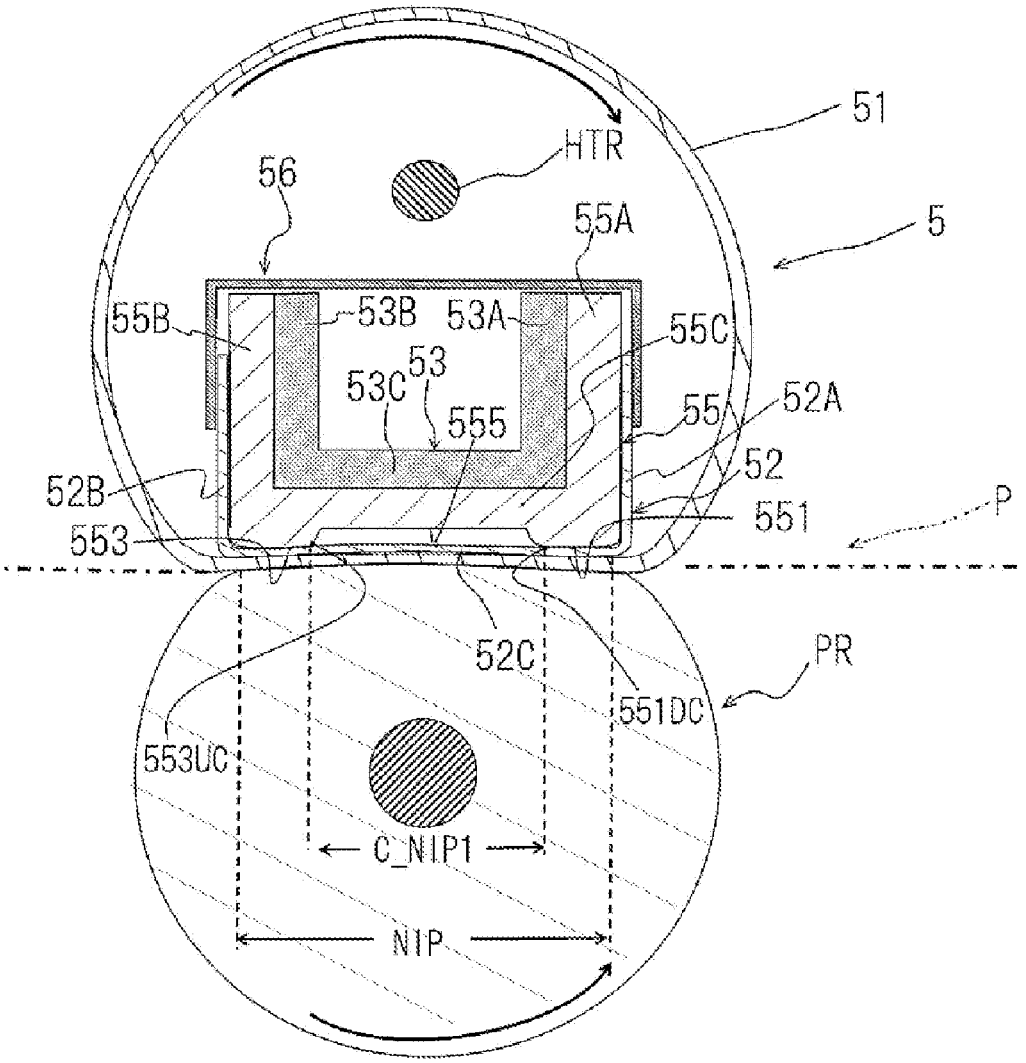
FIG. 9 is a cross-sectional view of the center of the fixing device.

Deformation of the nip plate 52 when the fixing nip (NIP) is formed due to the elastic supporting force of the spring SPR will be described below. FIG. 8 is a cross-sectional view of an end of the fixing device 5 and is a cross-sectional view taken along line B-B' of FIG. 4 (cross-sectional view taken along line C-C'). In other words, FIG. 8 is a cross-sectional view of the fixing device 5 taken along a plane passing through the end portion 553UE1 (553UE2) of the upstream edge 553U of the downstream support face 553 of the heat insulating member 55 and perpendicular to the longitudinal direction of the heat insulating member 55. FIG. 9 is a cross-sectional view of the center of the fixing device and is a cross-sectional view taken along line A-A' of FIG. 4. In other words, FIG. 9 is a cross-sectional view of the fixing device 5 taken along a plane passing through the central portion 553UC of the upstream edge 553U of the downstream support face 553 of the heat insulating member 55 and perpendicular to the longitudinal direction of the heat insulating member 55.

In the end portions of the heat insulating member 55, as illustrated in FIG. 8, since the gap in the conveyance direction (CD) between the downstream edge 551D of the upstream support face 551 and the upstream edge 553U of the downstream support face 553 is great, the nip plate 52 is greatly curved toward the depressed portion 555 of the heat insulating member 55 between the downstream edge 551D of the upstream support face 551 and the upstream edge 553U of the downstream support face 553. Accordingly, in the fixing nip (NIP), the size, in the conveyance direction (CD), of an area C_NIP1 formed by the part of the nip plate 52 curved toward the depressed portion 555 increases.

On the other hand, in the central portion of the heat insulating member 55, as illustrated in FIG. 9, since the gap in the conveyance direction (CD) between the downstream edge 551D of the upstream support face 551 and the upstream edge 553U of the downstream support face 553 is smaller than that in FIG. 8, the nip plate 52 is curved small toward the depressed portion 555 of the heat insulating member 55 between the downstream edge 551D of the upstream support face 551 and the upstream edge 553U of the downstream support face 553. Accordingly, in the fixing nip (NIP), the size, in the conveyance direction (CD), of an area C_NIP2 formed by the part of the nip plate 52 curved toward the depressed portion 555 is smaller than the area C_NIP1 in FIG. 8. Accordingly, the area of the fixing nip (NIP) in the central portion of the heat insulating member 55 is smaller than the area of the fixing nip (NIP) in the end portions of the heating insulating member 55. As a result, the sheet P passing through the fixing nip (NIP) is pulled from the center of the sheet P to the ends thereof.

As illustrated in FIG. 7, the upstream support face 551 and the downstream support face 553 of the heat insulating member 55 have a concave shape which is depressed in a bow shape so as to be separated from the nip toward the center in the longitudinal direction of the heat insulating member 55. Accordingly, when the fixing nip (NIP) is formed, the load at the ends in the longitudinal direction of the fixing nip (NIP) is greater than that at the center thereof. As a result, the sheet P passing through the fixing nip (NIP) is further pulled from the center of the sheet P to the ends thereof.

Advantageous effects acquired from the above-mentioned configurations will be described below.

Since the gap in the conveyance direction (CD) between the downstream edge 551D of the upstream support face 551 and the upstream edge 553U of the downstream support face 553 in the central portion of the heat insulating member 55 is smaller than that in FIG. 8 (the end portions of the heat insulating member 55) as illustrated in FIG. 9, the area of the fixing nip (NIP) in the central portion of the heat insulating member 55 is smaller than the area of the fixing nip (NIP) in the end portions of the heat insulating member 55. Accordingly, the sheet P is pulled from the center to the ends and it is thus possible to suppress a crinkle from being formed in the sheet P.

Here, since the gap in the conveyance direction (CD) between downstream edge 551D of the upstream support face 551 and the upstream edge 553U of the downstream support face 553 gradually decreases as approaching from the end portions in the longitudinal direction of the heat insulating member 55 to the center thereof, the area of the fixing nip (NIP) can gradually decrease from the ends in the longitudinal direction of the fixing nip (NIP) to the center. Accordingly, it is possible to stably convey the sheet P in the fixing nip (NIP).

Since the upstream support face 551 and the downstream support face 553 of the heat insulating member 55 have a concave shape which is depressed in a bow shape so as to be separated from the nip as approaching the center in the longitudinal direction of the heat insulating member 55 as illustrated in FIG. 7, the sheet P passing through the fixing nip (NIP) is further pulled from the center of the sheet P to the end. Accordingly, it is possible to further suppress a crinkle from being formed in the sheet P.

Modification Example 1

Figure 10:
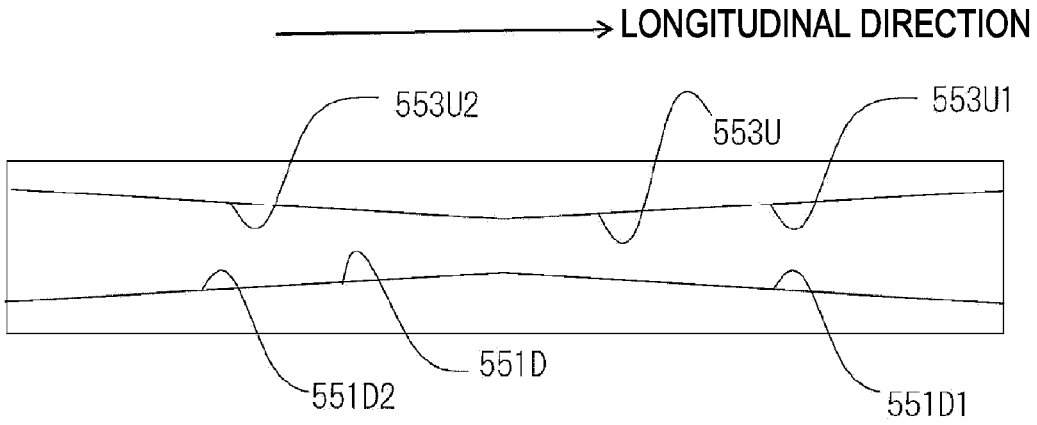
FIG. 10 is a view of a heat insulating member according to Modification Example 1 as viewed from the fixing nip.

In the above-mentioned embodiment, the downstream edge 551D of the upstream support face 551 and the upstream edge 553U of the downstream support face 553 have a bow shape, but the disclosure is not limited to this configuration. For example, as illustrated in FIG. 10, the downstream edge 551D of the upstream support face 551 and the upstream edge 553U of the downstream support face 553 may have a V shape.

More specifically, the downstream edge 551D of the upstream support face 551 includes a linear edge 551D1 which approaches the downstream support face 553 as approaching form one end in the longitudinal direction of the upstream support face 551 to the center thereof, and a linear edge 551D2 which approaches the downstream support face 553 as approaching from the other end in the longitudinal direction of the upstream support face 551 to the center thereof and which is connected to the edge 551D1. The upstream edge 553U of the downstream support face 553 includes a linear edge 553U1 which approaches the upstream support face 551 as approaching from one end in the longitudinal direction of the downstream support face 553 to the center thereof, and a linear edge 553U2 which approaches the upstream support face 551, as approaching from the other end in the longitudinal direction of the downstream support face 553 to the center thereof and which is connected to the edge 553U1.

Modification Example 2

Figure 11:
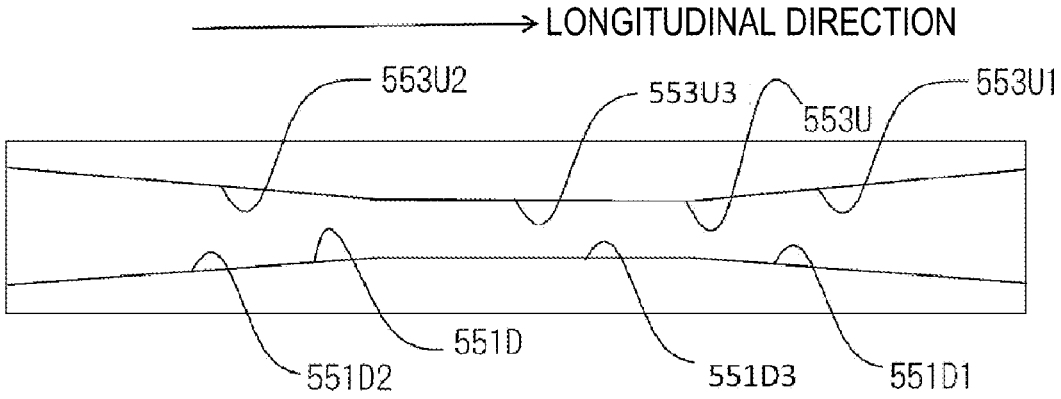
FIG. 11 is a view of a heat insulating member according to Modification Example 2 as viewed from the fixing nip.

In the above-mentioned embodiment, the downstream edge 551D of the upstream support face 551 and the upstream edge 553U of the downstream support face 553 have a bow shape, but the disclosure is not limited to this configuration. For example, as illustrated in FIG. 11, the downstream edge 551D of the upstream support face 551 includes a linear edge 551D1 which approaches the downstream support face 553 as approaching from one end in the longitudinal direction of the upstream support face 551 to the center thereof, an edge 551D2 which approaches the downstream support face 553 as approaching from the other end in the longitudinal direction of the upstream support face 551 to the center thereof, and an edge 551D3 which extends along the longitudinal direction of the upstream support face 551 and which connects the edge 551D1 and the edge 551D2. The upstream edge 553U of the downstream support face 553 includes a linear edge 553U1 which approaches the upstream support face 551 as approaching from one end in the longitudinal direction of the downstream support face 553 to the center thereof, an edge 553U2 which approaches the upstream support face 551 as approaching from the other end in the longitudinal direction of the downstream support face 553 to the center thereof, and a linear edge 553U3 which extends along the longitudinal direction of the downstream support face 553 and which connects the edge 553U1 and the edge 553U2.

What is claimed is:

1. A fixing device comprising:

an endless belt;

a heater, which extends inside the endless belt;

a nip plate, which is capable of being in contact with an inner circumferential surface of the endless belt;

a backup member, which forms a nip, where a recording sheet is to be conveyed in a conveyance direction, between the endless belt and the backup member by interposing the endless belt between the nip plate and the backup member;

a reflective plate, which is disposed between the heater and the nip plate;

a stay, which is disposed between the reflective plate and the nip plate; and a heat insulating member, which is interposed between the stay and the nip plate, wherein the heat insulating member includes:

an upstream support face, which supports the nip plate; and a downstream support face, which is disposed downstream in the conveyance direction separated from the upstream support face and supports the nip plate, wherein the conveyance direction is perpendicular to the heat insulating member, and wherein a gap in the conveyance direction between the upstream support face and the downstream support face at a central portion in a longitudinal direction of the heat insulating member is smaller than a gap in the conveyance direction between the upstream support face and the downstream support face at an end portion in the longitudinal direction of the heat insulating member.

2. The fixing device according to claim 1, wherein the gap in the conveyance direction between the upstream support face and the downstream support face gradually decreases as approaching from the end portions of the heat insulating member to the central portion in the longitudinal direction.

3. The fixing device according to claim 2, wherein a downstream edge in the conveyance direction of the upstream support face has a bow shape which swells toward the downstream support face.

4. The fixing device according to claim 2, wherein an upstream edge in the conveyance direction of the downstream support face has a bow shape which swells toward the upstream support face.

5. The fixing device according to claim 2, wherein a downstream edge in the conveyance direction of the upstream support face has a V shape which swells toward the downstream support face.

6. The fixing device according to claim 2, wherein an upstream edge in the conveyance direction of the downstream support face has a V shape which swells toward the upstream support face.

7. The fixing device according to claim 1, wherein the heat insulating member contains liquid crystal plastic.

8. The fixing device according to claim 1, wherein the upstream support face is depressed in a direction, in which it separates from the nip, as approaching from the end portion in the longitudinal direction of the heat insulating member to the central portion thereof.

9. The fixing device according to claim 1, wherein the downstream support face is depressed in a direction, in which it separates from the nip, as approaching from the end portion in the longitudinal direction of the heat insulating member to the central portion thereof.

10. The fixing device according to claim 1, wherein the central portion in the longitudinal direction of the heat insulating member overlaps a recording sheet conveyance center as viewed from a thickness direction of a recording sheet passing through the nip.

11. The fixing device according to claim 10, wherein the central portion in the longitudinal direction of the heat insulating member is the center in the longitudinal direction of the heat insulating member.

12. The fixing device according to claim 1, wherein the end portion in the longitudinal direction of the heat insulating member overlaps an end of a recording sheet conveyance area as viewed from a thickness direction of the recording sheet in the nip.

13. The fixing device according to claim 1, wherein a difference between the gap in the conveyance direction between the upstream support face and the downstream support face at the end portion in the longitudinal direction of the heat insulating member and the gap in the conveyance direction between the upstream support face and the downstream support face in the central portion in the longitudinal direction of the heat insulating member ranges from 0.1 mm to 6.0 mm.

14. The fixing device according to claim 1, wherein the nip plate includes a metal plate.

15. The fixing device according to claim 1, wherein the upstream support face and the downstream support face are separated from each other in the conveyance direction, from one end in the longitudinal direction of the heat insulating member to the other end thereof.

16. A fixing device comprising:

an endless belt;

a heater, which extends inside the endless belt;

a nip member, which comes into contact with an inner circumferential surface of the endless belt;

a backup member, which forms a nip between the endless belt and the backup member by interposing the endless belt between the nip member and the backup member;

a reflective member, which is disposed between the heater and the nip member;

a stay, which is disposed between the reflective member and the nip member; and an intermediate member, which is interposed between the stay and the nip member, the fixing device heat-fixing a developer on a recording sheet while conveying the recording sheet in a conveyance direction perpendicular to a longitudinal direction of the intermediate member in the nip, wherein the intermediate member includes:

an upstream support face, which supports the nip member; and a downstream support face, which is disposed downstream in the conveyance direction separated from the upstream support face and that supports the nip member, and wherein a gap in the conveyance direction between the upstream support face and the downstream support face at a central portion in a longitudinal direction of the intermediate member is smaller than a gap in the conveyance direction between the upstream support face and the downstream support face at an end portion in the longitudinal direction of the intermediate member.

17. The fixing device according to claim 16, wherein the gap in the conveyance direction between the upstream support face and the downstream support face gradually decreases as approaching from the end portion of the intermediate member to a center thereof in the longitudinal direction.

18. The fixing device according to claim 16, wherein a difference between the gap in the conveyance direction between the upstream support face and the downstream support face at the ends in the longitudinal direction of the intermediate member and the gap in the conveyance direction between the upstream support face and the downstream support face in the central portion in the longitudinal direction of the intermediate member ranges from 0.1 mm to 6.0 mm.

19. The fixing device according to claim 16, wherein the intermediate member includes a resin frame.

20. The fixing device according to claim 19, wherein the intermediate member includes a liquid crystal plastic frame.

* * * * *